US005322475A

United States Patent [19]

Irvin

[11] Patent Number: 5,322,475

[45] Date of Patent: Jun. 21, 1994

[54] PRACTICE CUE BALL

[76] Inventor: Barry L. Irvin, 3782 Glenwood Rd., Cleveland Hts., Ohio 44121

[21] Appl. No.: 849,889

[22] Filed: Mar. 12, 1992

[51] Int. Cl.[5] ..... A63B 37/00

[52] U.S. Cl. ..... 473/52

[58] Field of Search ..... 273/58, 58 E, 58 G, 273/58 H, 58 K, 59 R, 59 B, 2, 14, 24, 11 R, 22, 9, 12, 59 A, 63 A, 63 B, 352, 63 E, 63 R, 63 C; 33/390; D10/69, 74

[56] References Cited

U.S. PATENT DOCUMENTS

| | | | |
|---|---|---|---|
| 575,128 | 1/1897 | Rockwell | 273/63 E |
| 3,318,598 | 5/1967 | Ruskin | 273/63 C |
| 3,630,601 | 12/1971 | Lebovec | 273/63 R |
| 3,807,733 | 4/1974 | Dearmont | 273/63 R |
| 5,102,131 | 4/1992 | Remington | 273/58 G |

OTHER PUBLICATIONS

Brunswick, p. 23.

*Primary Examiner*—Theatrice Brown

*Attorney, Agent, or Firm*—Fay, Sharpe, Beall, Fagan, Minnich & McKee

[57] ABSTRACT

A cue ball, suitable for practice purposes, into which a circular hole is drilled and the core material removed therefrom. The core material is then replaced with a circular level. Perpendicular to the circular level is a pattern which allows for, or directs placement of, the cue tip upon the ball. As a result, the invention provides a user with a basic target area for developing english or spin upon the ball. The leveling devices allows the user to position the ball in the same position, presenting the target area to the user in a repeatable manner.

5 Claims, 2 Drawing Sheets

PRACTICE CUE BALL

BACKGROUND OF THE INVENTION

This invention relates to a novel practice cue ball and a method for developing "english" or spin on a cue ball through the use of such a practice cue ball.

More particularly, the preferred embodiment of the present invention is directed to a cue ball into which a circular hole is drilled and the core material removed therefrom. The core material is then replaced with a circular level. Perpendicular to the circular level, along the outer surface of the cue ball, is a pattern which allows for, or directs, placement of the cue tip upon the ball. As a result, the practice cue ball visually provides a user with a basic target area for developing "english" or spin upon the ball. The leveling device allows the user to consistently orient the ball in the same position, presenting the target area to the user in a repeatable manner, no matter where it is located on the playing surface.

While the invention is particularly directed to the art of practice cue balls, and will be thus described with specific reference thereto, it will be appreciated that the invention may have usefulness in other fields and applications.

Any game requiring the use of a cue ball will necessarily require the development of english, or spin, upon such cue ball. English is defined as the spin applied to a ball by striking it in a particular location. More specifically, "right english" is the spin applied to a ball by striking it to the right of center to create a counterclockwise spin on the ball. "Left english" is the spin applied to a ball by striking it to the left of center to create a clockwise spin on the ball. "Draw" is the spin applied to a ball by striking it below center to create a back spin. "Follow" is the spin applied to a ball by striking it above center to create a forward spin. These and other various types of spin are applied to the ball through use of a stroke, defined as the movement of the hands and arms to strike a ball with a stick, pool cue, billiard stick, or other apparatus.

The development and application of the stroke necessary to produce the spin or the ball movement desired is difficult to master. Use of a teaching aid or a training device to enhance the development of the hand-eye coordination and/or muscle memory necessary to repetitively produce such an effect will be beneficial.

Heretofore, a training cue ball that assists a user in creating spin on such cue ball has not been developed. In particular, to the inventor's knowledge, no one has developed a cue ball including a pattern which provides a user with basic target areas for developing english. Further, no method or apparatus to ensure that the practice cue ball can be consistently placed in the same position, thus presenting the pattern to the user in a repeatable fashion, has been developed.

A wide variety of pool or billiard balls and closely related training devices having visible training patterns are known. For instance, U.S. Pat. No. 1,108,441 to Hubbell discloses pool balls with zig-zag patterns placed thereon to aid in visually determining the relative angle or position of the pool balls. U.S. Pat. No. 3,993,305 to Nicholson shows pool balls including variably colored segments which aid in selecting a point at which a cue ball should strike an object ball by the use of an imaginary line extending through the center of the ball and the desired pocket. Additionally, U.S. Pat. No. 3,947,026 to Scoutten and U.S. Pat. No. 3,843,120 to Ricci disclose training devices which aid in teaching the true point of aim and/or desired points of contact to be used in a pool or billiards game.

None of these prior patents, however, show a cue ball with a pattern visible on or through the outer surface of the cue ball for development of english or a levelling device included therein to allow the cue ball to be consistently placed in the same position, thus presenting the pattern to the user in a repeatable manner.

SUMMARY OF THE INVENTION

Accordingly, an object of the present invention is to provide a practice cue ball for aiding a user in developing english on the cue ball by presenting the user, prior to and during a stroke, with basic target areas of the cue ball.

A further object of the present invention is to provide a practice cue ball which can be repeatedly placed in the same position for training purposes by utilizing a leveling device inserted in the cue ball.

The above objects are achieved in a preferred embodiment of the present invention by providing a practice cue ball which has symbols or graphics disposed thereon to aid a user in developing english on the ball. The pattern identifies proper target areas and may be color coded for ease of use. Any number of intermediate targets may be identified in the graphic design in any number of different configurations. Different configurations allow for the development of different types of english, i.e., right english, left english, follow, draw.

Further, a leveling device is assembled in the ball approximately 90° along the outer surface of the ball from the center of the target area relative to a point in the center of the cue ball. This device may be of any type which will cause the ball to be leveled in any manner. However, in the preferred embodiment, a circular level is used. The leveling device allows the user to position the ball in exactly the same position every time a training stroke is taken. The target area is presented to the user in a repeatable manner no matter where it is located on the table or playing surface.

Further scope of the applicability of the present invention will become apparent from the detailed description provided below. It should be understood, however, that the detailed description and specific examples, while indicating preferred embodiments of the invention, are given by way of illustration only, since various changes and modifications within the spirit and scope of the invention will become apparent to those skilled in the art.

DESCRIPTION OF THE DRAWINGS

The present invention consists in the construction, arrangement, and combination, of the various parts of the device, whereby the objects contemplated are attained as hereinafter more fully set forth, specifically pointed out in the claims, and illustrated in the accompanying drawings in which:

DETAILED DESCRIPTION OF THE PREFERRED EMBODIMENTS

Figure 1:
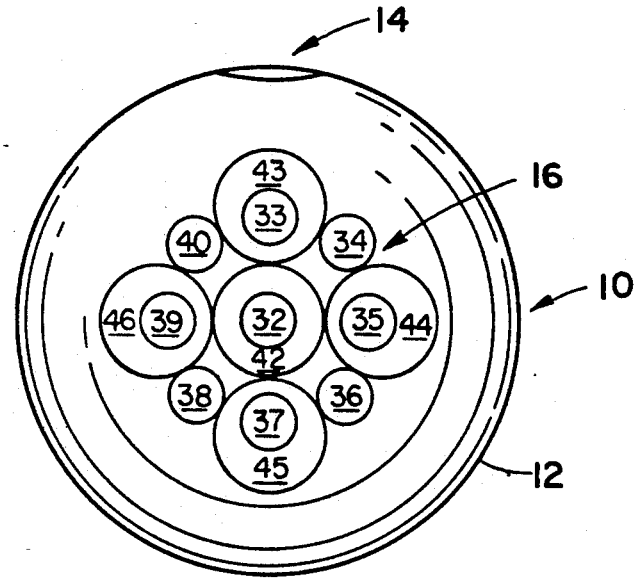
FIG. 1 is a front elevational view of the practice cue ball herein contemplated.
Figure 4B:
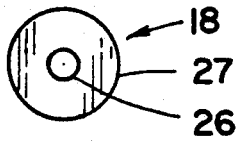
FIG. 4*b* is a top elevational view of the circular level of FIG. 4*a*.

Referring now to the drawings wherein the showings are for the purposes of illustrating the preferred embodiments of the invention only and not for purposes of limiting same, FIG. 1 provides a view of the overall preferred embodiment. As shown, the practice cue ball 10 is comprised of a spherical body 12, a leveling means 14, the markings, or pattern, 16.

As shown in FIG. 1, the pattern 16 is comprised of a plurality of suitably placed circles forming a substantially diamond shape. The plurality of circles include small circles 32–40 and large circles 42–46. The arrangement of small and large circles 32–40 and 42–46, respectively, enables a user to develop english on the cue ball 10.

For instance, right english can be developed on the cue ball 10 by striking the cue ball 10 at a spot designated by markings 35 or 44. Similarly, left english can be developed on the cue ball 10 by striking markings 39 or 46. Draw is developed by striking 37 or 45. Follow is developed by striking 33 or 43. Additionally, combinations and variations of these types of spins can be developed by striking other spots on the pattern including 34, 36, 38, and 40. Although the particular pattern 16 is preferred, it is appreciated that any graphic design may be utilized to develop english or spin on the ball. Additionally, the pattern 16 may be color coded in various ways to facilitate ease of training.

Figure 2:
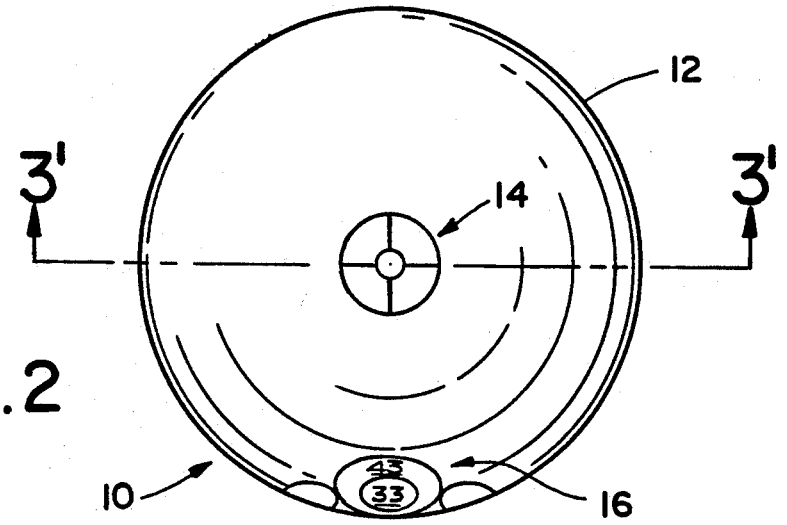
FIG. 2 is a top elevational view of the cue ball of FIG. 1.

FIG. 2 shows a top elevational view of the cue ball 10. Note from FIGS. 1, 2, 3*a* and 3*b* that the leveling means 14 is placed approximately 90° from the center of the target area relative to a center point 11 (more particularly described with reference to FIGS. 3*a* and 3*b*) of body 12 and along the outer surface of the body 12. It is acknowledged that a pattern may be placed anywhere on the cue ball relative to the leveling means and still fall within the scope of the invention.

Figure 3A:
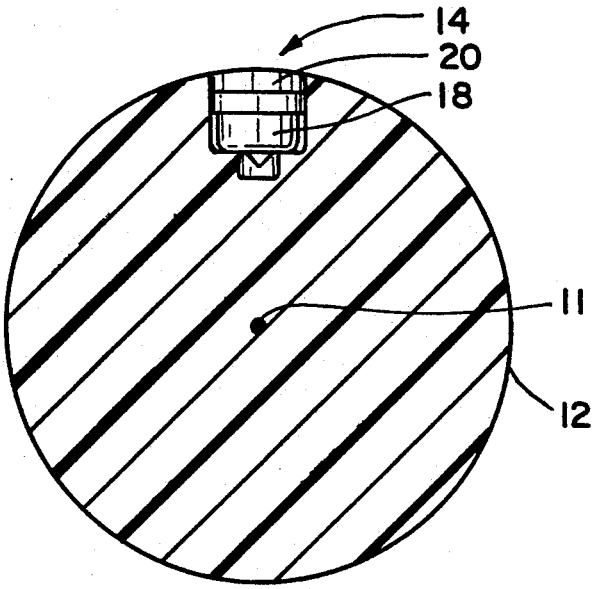
FIG. 3*a* is a cross-sectional view of the practice cue ball along line 3'—3' of FIG. 2 including the level and the lens.

FIGS. 3*a* and *b* show a cross-sectional view of the cue ball 10. Included in the views is the center point 11. The Center point 11 is merely a reference point useful in describing the relative positions of the elements of the cue ball 10.

FIG. 3*a* shows a cross-sectional view including the leveling means. As shown, the leveling means is comprised of a circular level 18 and a protective lens 20.

Figure 3B:
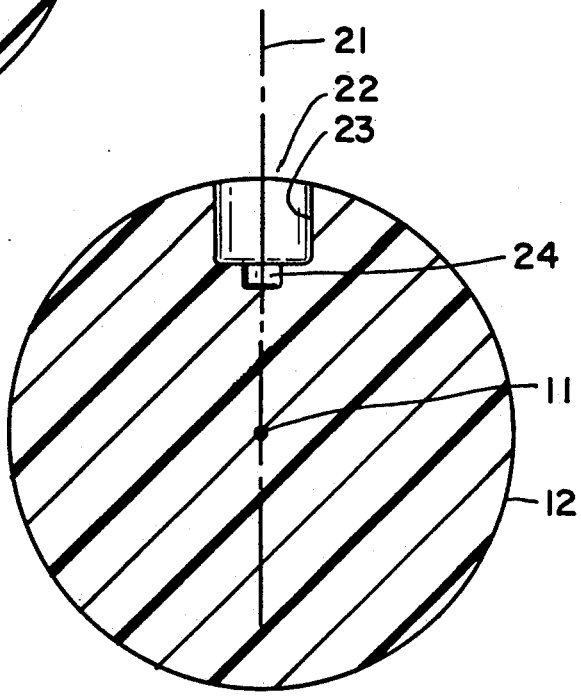
FIG. 3*b* is a cross-sectional view of the cue ball along line 3'—3' of FIG. 2 with the level and the lens removed.

FIG. 3*b* shows the same cross-sectional view of FIG. 3*a* excluding the circular level and the lens. As is shown, a hole 22 is bored in the body 12 to accommodate the leveling means 14. The hole 22 is generally cylindrical in shape and is comprised of upper bore 23 and lower bore 24. Note that upper bore 23 has a diameter significantly larger than that of lower bore 24. For example, in the preferred embodiment, the upper bore 23 is approximately ⅜" in diameter while the lower bore 24 is approximately ⅛" in diameter. It is appreciated, however, that the dimensions of the bores 23 and 24 can be of any value. Further note that the upper bore 23 and the lower bore 24 are disposed concentrically about the same longitudinal axis 21. While hole 22 accommodates the leveling means of the preferred embodiment, it is appreciated that the hole 22 could be formed in any shape, configuration, or manner to accommodate a leveling means of varying size and shape.

Figure 3C:
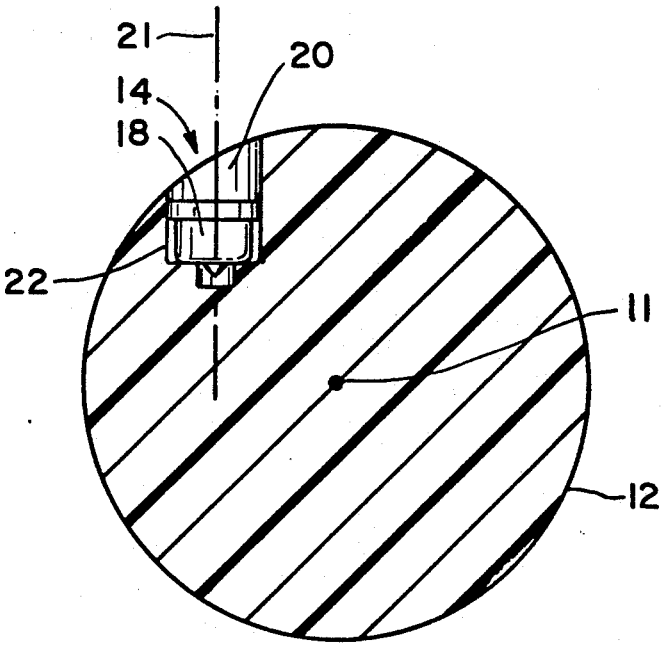
FIG. 3*c* is a cross-sectional view of the cue ball of FIG. 1 with the levelling means disposed in an alternative position.

Additionally, although in the preferred embodiment the hole 22 is bored to designate the top of the ball, it can be formed anywhere in the body 12 to accommodate convenient viewing of the leveling means 14. For example, FIG. 3*c* shows that the hole 22 is bored so that the longitudinal axis 21 of the hole 22 remains perpendicular to the playing surface as in the preferred method of use of the practice cue ball 10, more particularly described below; however, the leveling means is not located at the top of the cue ball 10. The positioning of the hole 22 in this manner will allow the user to view the leveling means 14 while eyeing the pattern 16, poised to strike the cue ball 10.

It is appreciated that the above variation in placement of the hole 22 requires further alteration of the preferred embodiment. For instance, the lens 20 of FIG. 3*c* is of an unconventional shape to accommodate the curvature of the cue ball 10. Additionally, since the leveling means 14 is viewed from an angle other than directly above, as in the preferred embodiment, alternative indications or readings of the leveling means 14, i.e., apparent position of the bubble or the like, should be taken into account when viewing it. Further, it is appreciated that an alternative leveling means 14, better suited to function when the hole 22 is not bored as in the preferred embodiment, can be used.

Figure 4A:
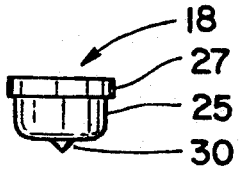
FIG. 4*a* is a front elevational view of the circular level.

FIGS. 4*a* and *b* provide a detailed description of the circular level 18. As is shown in the figures, circular level 18 is comprised of a middle portion 25, a top portion 27 and a base portion 30. In the preferred embodiment, the circular level 18 is approximately ¼" in height and ⅜" in diameter, although the inventor recognizes that the scope of the invention is not specifically limited as such. Additionally, circular level 18 includes a "bullseye" 26 imprinted on the top portion 27. The bullseye 26 aids a user in correctly leveling the cue ball. In particular, the bubble contained in the circular level 18 is centered in the bullseye to indicate that the cue ball 10 is properly oriented. It is appreciated by the inventor that a leveling means 14 of any size, shape and configuration can be suitably used to aid in leveling the cue ball. The circular level 18 is described only to the extent that it is an element of the preferred embodiment.

As an alternative to the circular level 18, a similarly constructed leveling device utilizing a pellet or the like, supported by a suitable liquid or merely air, instead of the bubble, can be used. It is appreciated that a leveling device of this nature would function in a different manner than the circular level 18. For instance, the bubble of the circular level 18 rises to the surface of the liquid in which it is disposed. The pellet would settle to the bottom of the leveling device unless the support liquid is of a greater density than the pellet. It is recognized that a curved bottom of the pellet leveling device is most suitable. Further, a bullseye pattern or the like could suitably be placed on the curved bottom to facilitate ease of leveling. While not preferred, the above alternatives are contemplated by the inventor and fall within the scope of the invention.

Figure 5B:
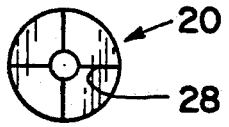
FIG. 5*b* is a top elevational view of the lens of FIG. 5*a*.
Figure 5A:
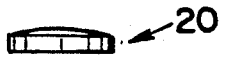
FIG. 5*a* is a front elevational view of the lens.

FIGS. 5*a* and *b* illustrate the configuration of the lens 20. In particular, the lens 20 acts as a protective cover for the circular level 18. While a lens of any size and configuration will serve the purpose of protecting the circular level 18, a lens 20 fitting into the hole 22, approximately ⅜" in diameter, and having an arc identical to that of the cue ball 10 is preferred as this configuration will allow the cue ball 10 to roll freely. Also note in FIG. 5*b* that the lens 20 may suitably include a bullseye and hairlines 28 imprinted thereon to further aid a user in correctly leveling and/or orienting the cue ball 10.

Further, it is recognized that the lens 20 need not be included in the invention at all. For instance, a suitable circular level having sufficiently sized and appropriately curved top portion could function similar to the lens 20. Additionally, it is appreciated that the lens 20, or a similarly functioning mechanism, is not even required to fall within the scope of the invention. Certainly, the lack of a lens 20 in a practice cue ball such as the one disclosed would alter the rolling of the ball after being struck. However, this would not alter the scope of the invention. It would only limit the effectiveness of the practice stroke as a regulation cue ball would not behave as such after being struck. The lens 20 is included in the preferred embodiment so that the user can simulate regulation play to the greatest extent possible.

It is recognized by the inventor that the materials used to form the elements of the invention are relatively well known in the art. For instance, the body 12 of the cue ball 10 can be formed of a phenolic material or the like, ivory, or any other hard material ordinarily used for formation of pool or billiard balls. It is also within the scope of the invention to utilize a relatively clear or translucent material for the construction of the body 12 thereby allowing for the leveling means 14 to be viewed in the body 12 of the cue ball 10 from an angular or non-linear position.

For instance, if a translucent cue ball 10 is used, the leveling means 14 can be placed anywhere within the body 12 in any manner so that it can be conveniently viewed by the user. The leveling means 14 could be of any suitable type to accomplish this end. Further, the pattern 16 may suitably be formed in the translucent body 12 by any known method as opposed to merely being placed on the outer surface, as in the preferred embodiment. This, obviously, would result in a longer usable life for the pattern 16.

Additionally, the translucent cue ball 10 could be provided with a large cavity, thereby providing a hollowed-out center. The hollowed center could be filled with a suitable liquid and a viewable leveling means. Specifically, a suitable leveling device could be placed in the liquid or merely a bubble could be formed so that the whole cue ball 10 could also act as a leveling device. Alternatively, the hollowed center could be provided with a pellet or the like. In conjunction with proper markings disposed on the bottom of hollowed center, the pellet would act as a leveling means. While this alternative is not preferred, it certainly falls within the scope of the invention.

The circular level 18 can be of any material ordinarily used to manufacture such levels. Last, the lens 20 can be formed of any acrylic or otherwise hard transparent material suitable for protecting the circular level 18 and aiding in correctly leveling the cue ball 10. It is appreciated that a magnifying material may also be suitable for forming lens 20. It is preferred that the material used to construct the circular level 18 and the lens 20, or any suitable leveling means 14, be of a density that closely resembles that of the body 12. This will provide a practice situation more closely resembling that of regulation play, at least with respect to the behavior of the cue ball 10 subsequent to being struck.

The cue ball 10 of the preferred embodiment is formed by boring the hole 22 in the regulation body 12 so that the upper portion 23 and the lower portion 24 are suitably disposed about the longitudinal axis 21. The circular level 18 is fixed, such as by the use of a press fit, into the hole 22. Accordingly, the base portion 30 of the circular level is supported in the lower bore 24 of the hole 22. The middle portion 25 and the top portion 27 are supported in the upper bore 23 of the hole 22. The lens 20 is then fixed, such as by the use of a press fit, into the hole 22 thereby providing a protective cover for the circular level 18. Subsequent to the insertion of leveling means 14, the pattern 16 is placed on the cue ball 10. Ideally, the center of the pattern 16 is placed approximately 90° from the center of the circular level 18 relative to the center point 11 along the outer surface of the cue ball 10. It is appreciated that the pattern 16 can suitably be placed on the body 12 prior to boring the hole 22, as well.

Alternatively, the leveling means 14 could be secured in the hole 22, at least partly, through the use of a polymeric, or polycarbonate, material. In particular, the circular level 18 could be suitably placed in the hole 22. An injection molding process could then be utilized to form a lens or the like therein. It is recognized that known grinding and buffing techniques can subsequently be used to "finish" the injected material exposed. This alternative has recognized manufacturing advantages over the use of a press fit lens 20.

To properly manipulate the practice cue ball 10, a user need only orient the cue ball 10 so that the leveling means 14 indicates that the longitudinal axis 21 is perpendicular to the playing surface, or, more simply, that the cue ball 10 is upright. Pattern 16 is positioned, such as rotated, to face the user to provide for a striking target. The user can then strike the cue ball 10 at any point indicated on the pattern 16 to develop english on the cue ball 10. It is recognized that by striking the pattern 16 at different locations, different english can be developed. By striking the same location on the pattern 16 repeatedly, the user will develop the stroke, through muscle memory etc., necessary to apply a particular type of english to the cue ball 10 in a predictable manner.

The pattern 16 on the practice cue ball 10 provides visual targets to enhance the user's ability to visualize the target areas which provide different types of english on the ball. The leveling means 14 insures that the target areas will be presented to the user in a predictable manner.

It is appreciated that one skilled in the art of pool or billiards may wish to manipulate the pattern 16 in a different manner than is suggested herein. For instance, a skilled artisan may desire to position the pattern 16 in a manner so that it does not squarely face him/her prior to striking the cue ball 10 to create varying effects. Such variations fall within the scope of the invention.

The above description merely provides a disclosure of particular embodiments of the invention and is not intended for the purpose of limiting the same thereto. As such, the invention is not limited to only the above described embodiments. Rather, it is recognized that one skilled in the art could conceive alternative embodiments that fall within the scope of the invention.

Having thus described the invention, I claim:

1. A practice cue ball for use on a flat, horizontal playing surface, the ball comprising:

a spherical body having an outer surface equally disposed about a point centrally located therein, the body being formed of hard material;

a pattern disposed on the outer surface, the pattern having a center;

a substantially cylindrical hole bored in the spherical body at a location along the outer surface 90° from the center of the pattern relative to the point, the hole having a longitudinal axis extending therethrough; and, a leveling means disposed in the hole for orienting the body so that the longitudinal axis of the hole is perpendicular to the playing surface.

2. The practice cue ball according to claim 1 wherein the leveling means comprises a circular level.

3. The practice cue ball according to claim 2 wherein the leveling means further comprises an acrylic protective lens.

4. The practice cue ball according to claim 1 wherein the pattern comprises a plurality of circles.

5. A method for developing spin on a cue ball used on a flat, horizontal playing surface and with a cue stick, the cue ball comprising a spherical body having an outer surface and formed of hard material, a pattern disposed on the outer surface, a cylindrical hole having a longitudinal axis extending therethrough and bored in the body, and a leveling means disposed in the hole, the method comprising steps of:

orienting the cue ball with the leveling means so that the longitudinal axis is disposed perpendicular to the playing surface; and, striking the cue ball on the pattern with the cue stick.

* * * * *